United States Patent [19]

Price et al.

[11] 4,318,344

[45] Mar. 9, 1982

[54] SPINNING TUBULAR PROJECTILE COMBUSTIBLE SABOT

[75] Inventors: Raymond M. Price; John S. Ward, both of Ridgecrest, Calif.

[73] Assignee: The United States of America as represented by the Secretary of the Navy, Washington, D.C.

[21] Appl. No.: 99,355

[22] Filed: Dec. 3, 1979

[51] Int. Cl.[3] ..... F42B 13/16; C06B 45/10

[52] U.S. Cl. ..... 102/520; 149/19.6; 149/20; 149/22; 149/37

[58] Field of Search ..... 102/503, 520–523; 149/19.6, 20, 22, 37

[56] References Cited

U.S. PATENT DOCUMENTS

| | | | |
|---|---|---|---|
| 2,423,453 | 7/1947 | Howe | 102/92.5 |
| 3,171,764 | 3/1965 | Parker et al. | 149/19.6 |
| 3,268,477 | 8/1966 | Mueller | 149/19.6 |
| 3,297,503 | 1/1967 | Hoffmann et al. | 149/37 |
| 3,430,572 | 3/1969 | Hebert et al. | 102/93 |
| 3,490,967 | 1/1970 | Rhodes et al. | 149/19.6 |
| 3,673,014 | 6/1972 | Lone et al. | 149/19.6 |
| 3,680,483 | 8/1972 | Staudacher et al. | 149/19.6 |
| 3,705,549 | 12/1972 | Quinlan et al. | 102/40 |
| 3,724,377 | 4/1973 | Birkigt | 102/502 |
| 4,015,527 | 4/1977 | Evans | 102/38 |

*Primary Examiner*—Edward A. Miller

*Attorney, Agent, or Firm*—Robert F. Beers; W. Thom Skeer; Luther A. Marsh

[57] ABSTRACT

This invention relates to a combustible sabot and process for its preparation for a spinning tubular projectile. This combustible sabot is prepared in such a way and of such materials that it combusts spontaneously while exiting the gun barrel. The sabot is fabricated from an anhydride cured epoxy binder, boron, molybdenum trioxide, ammonium perchlorate and a metallic fuel selected from either aluminum or magnesium in the presence of a catalyst.

8 Claims, No Drawings

SPINNING TUBULAR PROJECTILE COMBUSTIBLE SABOT

BACKGROUND OF THE INVENTION

1. Field of the Invention

This invention relates to ammunition and firearms. More particularly, it relates to sabots for spinning tubular projectiles. Still more particularly, it relates to a combustible sabot for a tubular projectile. And, still further it relates to a novel composition and method for making a combustible sabot wherein it is consumed at a rate that substantially coincides with the projectile exit time from the weapon barrel.

2. Description of the Prior Art

Spinning tubular projectiles offer advantages over conventional non-tubular projectiles, among which are flatter trajectory, longer range, shorter flight time and superior penetration of the target.

When a tubular projectile is fired from a gun, it is preferable to plug the opening in the tube with a sabot. Because, the sabot provides surface area against which weapon gases can expand to impart momentum to the projectile. However, once the projectile leaves the barrel, the sabot must be removed in some manner. Removal is usually accomplished either by the sabot being installed in a tubular projectile in such a way that it drops out when the projectile leaves the weapon barrel, or that it be fabricated so that it disintegrates when the projectile leaves the weapon barrel.

A sabot that drops out or disintegrates upon exit from a weapon barrel has a real disadvantage when fired from an aircraft weapon, namely, the drop out or disintegrating sabot may be ingested into the aircraft engine. However, a sabot which completely combusts after having completed its job of providing surface area against which weapon barrel gases can expand leaves no debris to be ingested into an aircraft engine. Thus, combustible sabots are considered essential when the ammunition is to be fired from an aircraft weapon.

The combustible type sabots heretofore were either too weak to maintain the pressure in the weapon barrel, or burn too slowly at the pressure in the breech of the propellant powder, or too difficult or impossible to fabricate wherein the ultimate product is castable after being cured.

SUMMARY OF THE INVENTION

The combustible sabot, according to this invention, overcomes these problems. The combustible sabot of this invention is accomplished through the use of an epoxy anhydride binder compatible with and filled with energetic solid particles consisting of ammonium perchlorate, magnesium or aluminum, amorphous boron and molybdenum trioxide. The blended composition is castable and cures over the temperature range from about 60° C. to about 125° C.

The boron and molybdenum trioxide are preconsolidated into a blend to maintain intimate contact and sensitizes the composition to compressive ignition in the presence of finely divided air filled voids which are formed through controlled vacuum applications after mixing in air or by addition of a small quantity of phenolic or glass microballoons, that is, up to about four percent.

The sensitivity of the composition to compressive ignition is increased by the substitution of magnesium particles for aluminum particles. The ability of the cured composition to hold the pressure generated by propellant gases depends upon the sensitivity to the composition to ignition by compression, and the diameter of the sabot, that is, its form and the length of the sabot. It is useful in many tailored or customized diameters and lengths.

The installation of a sabot as disclosed by this invention is brought about by plugging the forward end of the projectile and depositing the above ingredients as a mixture in the tube behind the plug to a depth sufficient to fill about two thirds of the plugged portion of the tube. The tube is then placed in a vacuum chamber with its plugged (forward) end down and subjected to repeated evacuations and releases. The evacuation is carried out to a degree such that the mixture rises to a level about even with the upper or aft end of the tube and then released. The alternate evacuation and release is carried out from about ten to about twenty times. The remainder of the tube is then filled with the above ingredients, and they are then compacted and cured. This process yields a sabot having the proper number and size of voids that gives excellent combustion when the projectile is fired from a weapon. Hollow microspheres, of either phenolic or glass, may also be utilized to assist in rendering the sabot of this invention more readily combustible.

It is an object of this invention to make a new novel combustible sabot for a spinning tubular projectile. Another object is to make a combustible sabot in such a way and of such materials that it combusts spontaneously upon exiting a weapon barrel. Still another object is to make a combustible sabot that is utilized by ordnance or combat aircraft wherein substantially all risk of ingestion of sabot material by an engine is avoided. Other objects and advantages of the instant invention will become more apparent as the description proceeds hereinafter. The following tables and examples are further illustrative of the present invention and, it will be understood, however, that the invention is not limited thereto.

DESCRIPTION OF THE PREFERRED EMBODIMENT

The best mode for practicing the invention resides in fabricating a combustible sabot in a tubular projectile from a mixture of an anhydride curable epoxy resin, an anhydride curing agent, powdered boron, powdered molybdenum trioxide, powdered ammonium perchlorate oxidizer, and powdered magnesium fuel. Aluminum powder may also be used in lieu of the magnesium.

The various ingredients of the invention are defined and characterized in Tables 1, 2, 3, 4, and 5. The abbreviations used therein, such as, ERL-4221, NMA, HHPA, and so forth, are used hereinafter in lieu of the chemical name, formula, etc. The abbreviation BD is 1,4-butanedoil and, AP is the abbreviation for ammonium perchlorate.

TABLE 1

| Typical Properties and Applications | | |
|---|---|---|
| ERL-4221 | ERL-4289 | ERR-4205 |
| 3,4-Epoxycyclohexylmethyl- | | |

TABLE 1-continued

| | Typical Properties and Applications | | |
|---|---|---|---|
| | ERL-4221 | ERL-4289 | ERR-4205 |
| Chemical Name | 3,4-Epoxycyclohexane carboxylate | bis(3,4-Epoxy-6-methylcyclohexyl-methyl adipate | bis(2,3-Epoxy-cyclopentyl)ether |
| Structural Formula | 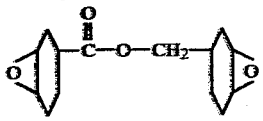 | 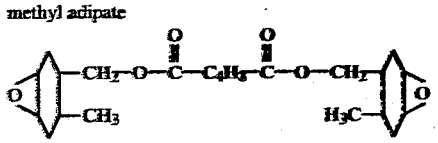 | 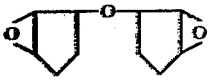 |
| Applications | General purpose casting resin. Filament winding Acid scavenger. Plasticizer. | For flexibilized products. | Used mainly as a reactive diluent or in high performance reinforced systems. Higher reactivity; high exotherm; amine hardeners |
| Viscosity, cps. | 350 to 450 (25° C.) | 500 to 1,000 (25° C.) | <100 (45° C.) |
| Apparent Specific Gravity at 25°/25° C. | 1.175 | 1.124 | 1.16 to 1.18 |
| Color 1933 Gardner maximum | 1 | 1 | 2 |
| Epoxy Equivalent Weight, grams/gram mol oxirane oxygen | 131 to 143 | 205 to 216 | 91 to 102 |
| Boiling Point at 760 mm. Hg. °C. | 354 | 258 (10 mm.) | — |
| Vapor Pressure at 20° C., mm. Hg | <0.1 | <0.1 | — |
| Freezing Point °C.[a] | −20 | 9 | 38 to 42 |
| Solubility, % by wt. at 25° C. In Water | 0.03 | 0.01 | — |
| Water In | 2.8 | 1.8 | — |

[a]Sets to glass below this temperature

TABLE 2

NADIC® METHYL ANHYDRIDE (NMA)

(Methylbicyclo [2.2.1]heptene-2,3-dicarboxylic anhydride isomers)

FORMULA: $C_{10}H_{10}O_3$

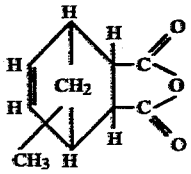

The positions of the double bond and the methyl group of the individual isomers comprising this mixture are unknown. The methyl group in this formula is drawn as being attached to the center of one ring to indicate that it replaces one of the hydrogens shown in the formula.

PHYSICAL PROPERTIES:

| | |
|---|---|
| Appearance | Clear, colorless to light yellow |
| Molecular Weight | 178.2 |
| Neutralization Equivalent | 89.1 |
| Viscosity, 25° C., cps. | 175–225 |
| Refractive Index, $n_D^{20}$ | 1.500–1.506 |
| Specific Gravity, $d_{20}^{20}$ | 1.200–1.250 |
| Flash Point (open cup), °C. | 140 |
| Distillation Range, °C., 10mm. Hg | 135–143 |
| Solidification Point, °C. | See footnote* |
| Solubility: | Miscible in all proportions at room temperatures with acetone, benzene, naphtha, and xylene. |

| Vapor Pressure: | Vapor Pressure | Temp. |
|---|---|---|
| | 1.5 mm | 102° C. |
| | 22 mm | 164° C. |
| | 50 mm | 181° C. |
| | 95 mm | 196° C. |
| | 470 mm | 243° C. |

*NADIC Methyl Anhydride has no definite freezing point. The only effect of decrease in temperature is that it becomes more viscous. No special handling or storage is needed in cold weather.

TABLE 3

| | |
|---|---|
| HEXAHYDRO-PHTHALIC ANHYDRIDE (HHPA) | 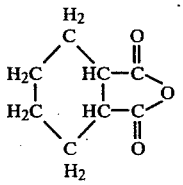 (cis-1,2-Cyclohexanedicarboxylic Anhydride |
| PHYSICAL PROPERTIES | Appearance: A glassy solid, which on melting gives a clear, colorless viscous liquid. |

TABLE 3-continued

| | |
|---|---|
| | Molecular Weight: 154.1<br>Solidification Point (as is), °C.: 35–36<br>Boiling Point, °C., 16.2 mm. abs.: 160.6<br>Density, 40° C., g./ml.: 1.18<br>Solubility: Miscible with benzene, toluene, acetone, carbon tetrachloride, chloroform, ethanol and ethyl acetate.<br>Only slightly soluble in petroleum ether.<br>Infrared Curve: See FIG. 1, pp. 4–5. |
| STRENGTH | Total acidity as hexahydrophthalic anhydride, 99% minimum. |

TABLE 4

DIMER ACIDS

Hystrene

Humko Sheffield's developing technology brings to market a range of Hystrene dimer acids to cover a variety of applications. There is, of course, the standard tall oil derived series. In addition, a series of dimer acids from other fatty acid sources offers a wide range of use. In many cases these new products (the X and S types) can be substituted for the tall oil dimers with little or no reformulation. Dimer acids impart flexibility into polymeric systems which has led to their use in polyesters, polyamides, polyurethanes, polyureas and epoxy systems. Dimer acids and their derivatives have found a myriad of end uses in such applications as corrosion inhibitors, metal-working lubricants, adhesives, inks and surface coatings.

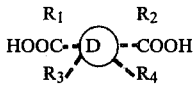

| | Specification | | | | | Typical | | | | |
|---|---|---|---|---|---|---|---|---|---|---|
| | | | | | | | | Composition | | |
| Product | Acid Value | Sap Value | Color Gardner (1963) | Neutral Equivalent | Monomer Acid | Viscosity at 25° C. (cSt) | Unsap | Monomer | Dimer | Trimer |
| Hystrene 3695 95% Dimer Acid | 194–198 | 198–202 | 5 Max | 283–289 | 1.5 Max | 6,800 | 0.5 | 1 | 95 | 4 |
| Hystrene 3695S 95% Dimer Acid | 197–202 | 198–203 | 7 Max | 278–285 | 1.5 Max | 11,000 | 1.0 | 1 | 95 | 4 |
| Hystrene 3695X 95% Dimer Acid | 195–199 | 196–200 | 7 Max | 282–288 | 1.5 Max | 7,200 | 1.0 | 1 | 95 | 4 |
| Hystrene 3680 80% Dimer Acid | 190–197 | 191–199 | 8 Max | 285–295 | 1 Max | 8,000 | 1.0 | Tr | 83 | 17 |
| Hystrene 3680S 80% Dimer Acid | 194–201 | 196–203 | 8 Max | 279–289 | 1,5 Max | 14,000 | 1.0 | 1 | 84 | 15 |
| Hystrene 3680X 80% Dimer Acid | 194–201 | 196–203 | 8 Max | 279–289 | 1.5 Max | 8,300 | 1.0 | 1 | 85 | 14 |
| Hystrene 3675 75% Dimer Acid | 189–197 | 191–199 | 9 Max | 285–297 | 1 Max | 9,000 | 1.0 | Tr | 75 | 25 |
| Hystrene 3675X 75% Dimer Acid | 192–200 | 193–201 | 9 max | 281–292 | 1 Max | 9,300 | 1.0 | 1 | 87 | 12 |
| Hystrene 3675C 75% Dimer Acid 3% Monomer | 189–197 | 191–199 | 9 Max | 285–297 | 3–4 Max | 7,500 | 1.0 | 3 | 75 | 22 |
| Hystrene 3675CS 75% Dimer Acid 3% Monomer | 194–201 | 196–203 | 8 Max | 279–289 | 4 Max | 12,000 | 1.0 | 3 | 85 | 12 |
| Hystrene 3675CX 75% Dimer Acid 3% Monomer | 192–200 | 193–201 | 9 Max | 281–292 | 4 Max | 8,000 | 1.0 | 3 | 86 | 11 |
| Hystrene 5460 Trimer Acid | 182–190 | 190–198 | | 295–308 | Tr | 30,000 | 1.0 | Tr | 40 | 60 |

DIMER AMINES

Kemamines

The dimer derivatives represent a marriage of Humko Sheffield dimer technology and fatty nitrogen chemistry. These high-molecular-weight fatty nitrogen chemicals have found use as corrosion inhibitors for petroleum-processing equipment and as intermediates, extenders and cross-linking agents in high-polymer systems.

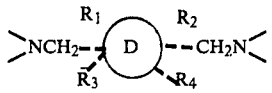

| Product | Description | Amine Value, Min Primary | Secondary | Total | Color Gardner Max (1963) | % Water Max |
|---|---|---|---|---|---|---|
| Kemamine DP-3680 | Dimer Diprimary Amine (3680) | 105 | | 175 | 14 | 1.0 |
| Kemamine DC-3680 | Dicyanoethylated Dimer Diprimary Amine (3680) | | 135 | 140 | 14 | 1.0 |
| Kemamine DD-3680 | Di-N-Aminopropyl Diprimary Amine (3680) | 135 | 135 | 280 | 14 | 1.0 |
| Kemamine DP-3695 | Dimer Diprimary Amine (3695) | 175 | | 185 | 14 | 1.0 |
| Kemamine DC-3695 | Dicyanoethylated Dimer Diprimary Amine (3695) | | 135 | 140 | 14 | 1.0 |
| Kemamine DD-3695 | Di-N-Aminopropyl Diprimary Amine (3695) | 135 | 135 | 280 | 14 | 1.0 |

TABLE 5

| Glass Microballoon Data | | |
|---|---|---|
| No. 1G25 Eccospheres | | |
| Emerson & Cumings, Inc. | | |
| Canton, Massachusetts | | |
| Gardena, California | | |
| Bulk density, lb/ft$^3$ | | 9.0 |
| g/cc | | 0.145 |
| True particle density | | |
| lb/ft$^3$ | | 14.8 |
| g/cc | | 0.237 |
| Particle size, (mu) | % | |
| >175 | 0 | |
| 149–175 | 6 | |
| 125–149 | 6 | |
| 100–125 | 13 | |
| 62–100 | 42 | |
| 44–62 | 12 | |
| < 44 | 21 | |
| Packing factor | 0.614 | |
| Average wall thickness, (mu) | 1.5 | |
| Softening temp °C. | 482 | |
| Strength-hydrostatic pressure | 44 | |
| [volume % survivors at 1500 psi (110kg/cm$^2$)] | | |

Note $\frac{.237}{2.65} = \sim \begin{matrix} .0894 \text{ glass} \\ .9106 \text{ air} \end{matrix}$ A sabot must meet two requirements to be useful. First, it must have enough compressive strength to withstand the pressure exerted on it by the expanding weapon gases. And, second, it must have properties which cause it to spontaneously combust due to all the interactions it undergoes when it is fired from a weapon. It has been found that a sabot fabricated from the above enunciated ingredients meet these requirements.

The preferred binders are (a) ERL-4289/HHPA type and (b) sixty five percent Dimer Acid blend with ERL-4221 and HHPA.

The preferred binders, compared to an ERL-4221/NMA system, yield the following improvements:

(a) HHPA-increases strength and heat resistance to deformation;

(b) ERL-4289-increases elongation of propellent;

(c) Dimer Acid-increases elongation of propellent;

(d) BD-required to provide hydroxyls for systems without acid;

(e) Sn (Octoate)$_2$-catalyst for all systems, and (f) solvent of ethylacetate or butyl acetate The preferred curing conditions occur at 65° C. for 24 hours and 120° C. for 48 hours. The blending of basic binder formulations are made to adjust strength of propellants, as desired, for sabot diameter and lengths.

EXAMPLES

| Preferred Propellent No. 1 | | |
|---|---|---|
| 4289/HHPA Type | | |
| ERL-4289 | | 19.10 |
| HHPA | | 6.70 |
| BD | | 0.24 |
| Sn(Oct)$_2$ | | 0.20 |
| Boron (amorphous) | Blend | 3.54 |
| MoO$_3$ | Blend | 20.06 |
| AP (90mu) | | 36.50 |
| Al (5mu) or Mg | | 13.66 |
| Compressive strength, psl | | 11,391 |
| Elongation at maximum strength, % | | 12 |
| Elongation at break, % | | 15 |
| Compressive modulus, psl | | 849,200 |

| Preferred Propellent No. 2 | | |
|---|---|---|
| Blend | 65% Dimer Acid formulation<br>35% HHPA | |
| ERL-4221 | | 12.91 |
| HHPA | | 3.28 |
| Dimer Acid | | 8.53 |
| BD | | 0.12 |
| Sn(Oct)$_2$ | | 0.16 |
| Boron (amorphous) | Blend | 2.25 |
| MoO$_3$ | Blend | 12.75 |
| AP (90mu) | | 30.00 |
| Al (5mu) or Mg | | 30.00 |

Tubes observed after experimental firings using the composition of this invention were found to be clean in comparison with other tubes utilizing ERL-4221/NMA system.

It is understood that the invention is not limited to the specific embodiments thereof except as set forth in appended claims, as many variations within the spirit and scope of the invention will occur to those skilled in the art.

We claim:

1. A sabot for a tubular projectile comprising: a binder comprising an epoxy resin and an anhydride, an intimate mixture of amorphous boron and molybdenum trioxide, ammonium perchlorate, a metal selected from the group consisting of aluminum and magnesium, and a catalyst.

2. A sabot as in claim 1 wherein the epoxy resin is selected from the group consisting of 3,4-epoxycyclohexylmethyl-3,4-epoxycyclohexane carboxylate and bis 3,4-epoxy-6-methylcyclohexylmethyl adipate.

3. A sabot as in claim 1 wherein the anhydride is selected from the group consisting of methylbicyclo [2.2.1] heptene-2,3-dicarboxylic anhydride isomers and cis-1,2-cyclohexane-dicarboxylic anhydride.

4. A sabot as in claim 3 wherein the binder further comprises a dimer acid.

5. A sabot as in claim 1 wherein the binder further comprises 1,4-butanediol.

6. A sabot as in claim 5 wherein said 1,4-butanediol is present in an amount from about 0.2% to about 3 percent of said binder composition.

7. A sabot as in claim 1 wherein said catalyst is tin octoate.

8. A sabot as in claim 7 wherein said tin octoate is present in an amount from about 0.2% to about 1.0% of said binder.

* * * * *